219-121 SR
6/25/85 XR 4,525,379

United States Patent [19]

Hübner et al.

[11] Patent Number: 4,525,379

[45] Date of Patent: Jun. 25, 1985

[54] METHOD OF MANUFACTURING AN ELECTRODE FOR A HIGH-PRESSURE GAS DISCHARGE LAMP AND ELECTRODE FOR SUCH A LAMP

[75] Inventors: Horst Hübner, Nümbrecht; Hans Lydtin, Stolberg; Ludwig Rehder; Thomas Zaengel, both of Aachen, all of Fed. Rep. of Germany

[73] Assignee: U.S. Philips Corporation, New York, N.Y.

[21] Appl. No.: 568,858

[22] Filed: Jan. 6, 1984

[30] Foreign Application Priority Data

Jan. 8, 1983 [DE] Fed. Rep. of Germany ..... 3300449

[51] Int. Cl.[3] ..... C23C 11/02

[52] U.S. Cl. ..... 427/53.1; 219/121 L; 313/346 R; 427/58; 427/255.7

[58] Field of Search ..... 427/53.1, 58, 78, 252, 427/255.7; 313/346 R, 355, 631, 633, 345; 219/121 L

[56] References Cited

U.S. PATENT DOCUMENTS

| | | | |
|---|---|---|---|
| 3,132,279 | 5/1964 | Lewin | 313/633 |
| 3,248,591 | 4/1966 | Arndt | 313/345 |
| 3,957,474 | 5/1976 | Kobayashi et al. | 427/53.1 |
| 4,340,617 | 7/1982 | Deutsch et al. | 427/53.1 |
| 4,451,503 | 5/1984 | Blum et al. | 427/53.1 |

FOREIGN PATENT DOCUMENTS

| | | | |
|---|---|---|---|
| 135013 | 4/1979 | German Democratic Rep. | 313/633 |
| 55-155457 | 12/1980 | Japan | 313/633 |

*Primary Examiner*—John H. Newsome
*Attorney, Agent, or Firm*—Norman N. Spain

[57] ABSTRACT

A thickened part (1) of a high-melting metal, which may contain emitter material, is formed on a carrier (2) of a high-melting metal. In order to manufacture such electrode structures in mass production and to obtain both various material transitions and combinations and optimum designs, the thickened part (1) is formed by reactive deposition from the gaseous phase (CVD method), preferably by laser-supported deposition from the gaseous phase.

12 Claims, 7 Drawing Figures

METHOD OF MANUFACTURING AN ELECTRODE FOR A HIGH-PRESSURE GAS DISCHARGE LAMP AND ELECTRODE FOR SUCH A LAMP

The invention relates to a method of manufacturing an electrode for a high-pressure gas discharge lamp, in which a thickened part formed of a high melting metal, which may contain emitter material, is provided on a carrier of a high-melting metal. The invention further relates to an electrode for such a lamp.

High-pressure gas discharge lamps comprise a gas-filled glass envelope, in which two metal pins, the electrode pins, are coaxially arranged. The actual light source is a discharge arc produced between the ends of the pins, the electrode tips. The electrodes are heated by the discharge arc plasma.

The most important points for consideration for the construction of the lamp electrodes are:

the electrodes have to be led out of the lamp envelope in a gas-tight and temperature-resistant manner;

it has to be guaranteed that the discharge arc has a defined termination point, which has a temperature sufficient for the required electron emission;

the electrodes must have in their hot regions a defined radiation surface (radiator), which determines together with the actual current supply the thermal control of the electrodes and which can serve for receiving emitter material;

in order to obtain a high luminance, high arc currents have to be produced, which in turn lead to a strong heating of the electrodes (arc end losses).

Although the electron emission is favoured by the heating of the electrodes, this heating must not exceed material-dependent limits. An optimum compromise between these marginal conditions is obtained due to the fact that the cooling is determined by emission of radiation. This further has the advantage that the lead-through member in the wall is not excessively thermally loaded.

An effective cooling by radiation of the electrode tip is attained when the radiating surface is enlarged, when the electrode tip is thickened. As a result, the volume and hence the heat capacity of the electrode tip are increased at the same time so that a stabilization of the temperature of the electrode tip in alternating-voltage periods is attained. The enlargement of the radiating surface can also result in that a more uniform surface load of the walls of the lamp envelope is guaranteed. Thickening of the electrode tip further allows the manufacturing curved, but smooth electrode surfaces, as a result of which defined conditions for the termination points of the arc can be obtained.

In order to satisfy these conditions, the electrodes usually consist of a lead-through pin or an assembly of foil and pin having a thickened part adapted to the lamp construction and consisting of a heavy metal, generally tungsten, at the electrode tip.

It is known to manufacture such structures of several mouldings consisting in part of different materials by welding them together or winding them with braced wire as shown in DE OS No. 2835904 corresponding to U.S. Pat. No. 4,136,298.

A method of the kind mentioned in the opening paragraph is known from DE OS No. 2524768 corresponding to U.S. Pat. No. 4,002,940. In this method, the thickened part, which is designated therein as electrode head is manufactured by moulding and sintering of tungsten powder, a metal carbide powder and a binder, is shrunk during sintering onto a tungsten pin employed as a carrier and is heated after sintering until it melts at least in part and assumes the desired form. The electrode thus manufactured has the form of a lobe, so of an elongate object with a thicker end. An electrode having a drop-shaped thickened part or having a hood or dome whose thickeness increases towards the electrode end is described in FIG. 5 of DE OS No. 2524768.

The disadvantages of these mechanical methods are:

many partly complicated separate processing steps and production-technical difficulties in the manufacture of very small structures for miniaturized discharge lamps.

The invention has for its object to manufacture the said electrode structures in mass production, whereby both various material transitions and combinations and optimum designs are obtained.

According to the invention, this is achieved in that the thickened part is formed by reactive deposition from the gaseous phase, for example by the use of a CVD method.

The carrier, for example a metal pin or a lead-in wire, preferably consists of one of the metals niobium, molybdenum or tungsten and the applied thickened part, which for example may be shaped as a hood or a dome, preferably consists of tungsten.

According to a further embodiment of the invention, the carrier, for example a metal pin or a lead-in wire, is coated before the formation of the thickened part, for example, shaped as a hood or a dome, by the same method with a layer for protection against corrosion, preferably consisting of tantalum.

In the method according to the invention, it is further advantageous to dope the thickened part with an emitter material, especially thorium, by simultaneous deposition.

In another preferred embodiment of the invention, the thickened part is provided on a rotation-symmetrical carrier, for example on a round pin. In certain cases it is advantageous to form the thickened part on a flat carrier, for example on a foil. The thickened part is preferably formed on one end of the carrier.

In a further preferred embodiment of the invention, more particularly with the use of a rotation-symmetrical carrier, the CVD method is controlled so that a rotation-symmetrical, thickened part, for example a spherical, semispherical or drop-shaped thickened part, is formed. In certain cases, especially with the use of a flat carrier, it is favourable to form a biradial thickened part on the carrier.

An electrode structure for high-pressure gas discharge lamps is manufactured in accordance with the invention in that, for example, there is formed on a fine lead-in wire a hood or dome with a thickness increasing towards the electrode end and consisting of a high-melting metal by controlled deposition from the gaseous phase (CVD method).

The technique of deposition of heavy metals, separately or simultaneously with other components, on various carriers or substrates by means of the CVD method is well known (for example, W. A. Bryant, J. Mat. Sci. 12 (1977), 1285–1306). However, in the lamp technique only wires for incandescent lamps have been manufactured hitherto in this manner (U.S. Pat. No. 575,002; J. Electrochem. Soc. 96 (1949), 318–333).

The layers produced by such methods have an extremely strong adhesion to the substrate, are of high purity and substantially reach the theoretical density of the corresponding elements. In most of the CVD methods, the starting material is a metastable reactive gas mixture, which reacts only at the heated surface of the substrate to be coated so that the desired substance is deposited. In the case of the thoroughly examined tungsten deposition this process can be described by the gross reaction $$WF_6+3H_2 \rightarrow W\downarrow +6HF\uparrow$$

The structure and the homogeneity of the deposited layers mainly depends upon the parameters pressure, temperature and substrate surface. If a substrate with deep recesses or pores should be uniformly coated on its surface, pressure and temperature have to be chosen so low that a uniform deposition takes place also in the pores and recesses. If the pressure and temperature are chosen to be higher, the deposition preferably takes place at the entrance of the pores, but scarcely on the bottom of the pores (v.d.Brekel, Philips Res. Repts., Part I, 32 (1977), 118–135, Part II, 32 (1977), 134–146).

Whereas in the usual applications of the CVD method the process control takes place so that a uniform coating is obtained, according to the invention the process parameters are chosen very advantageously towards the formation of a non-uniform layer thickness.

If, for example, electrode pins of the material for the lead-through of the envelope are arranged at small relative distances so that the pins project only over half their length into the reactive gas volume of a CVD reactor, the coating can be controlled by the choice of pressure and temperature so that preferably the pin tips are coated. In addition to this desired effect the further advantage is obtained that with the required layer thicknesses of 50 to 500 μm the morphology of the electrode pins contributes to a preferred deposition being obtained at the edges and tips of the front pin end.

Thus, the method according to the invention permits in a comparatively simple manner of simultaneously manufacturing large numbers of identical electrodes (pin matrices comprising 50×50 pins can even in laboratory experiments be coated already without great difficulty). Further, various materials can be deposited successively or simultaneously in the same equipment (emitter materials, protective layers). The method is particularly suitable for the manufacture of electrodes for miniaturized lamps because comparatively small pins can be provided rapidly and accurately with layer structures of sufficient thickness. It is further a particular advantage of the CVD coating method that the pins can have a substantially arbitrary form and consequently are not necessarily rotation-symmetrical with respect to their longitudinal axis.

In the method according to the invention, for example, lead-through pins of electrodes are coated at their tips in a thermally heated CVD reactor. In order to avoid that not only the pins, but also the remaining reactor surfaces are coated (reduction of the effective yield) and in order to shorten the coating duration (for 500 μm thick layers the coating times lie, dependent upon the process conditions, between 200 and 500 minutes), the thickened part is formed not only according to an embodiment mentioned above, but more generally according to a preferred embodiment of the method in accordance with the invention, by laser-supported deposition from the gaseous phase. The pin is then preferably heated by means of a high-power laser, more particularly a $CO_2$ laser or an Nd-YAG laser. In an embodiment of this preferred variation of the method, the electrode tips project from a holder into a gas mixture, which comprises the components to be deposited in the form of a compound (for example, W in the compound $WF_6$). The electrode tip and the gas directly surrounding it are then heated in that a laser beam is focused onto the tip. By coupling the laser radiation in at the front face of the electrode, without further steps being taken, a preferred coating of the front tip is obtained because of the temperature decrease occurring across the electrode pin from the tip down to the base in the holder. This variation of the method is distinguished in that both a high output and a high deposition rate are obtained.

In a further embodiment of the laser-supported electrode manufacture, a carrier wire, which is passed through a reactor, is heated at discrete areas along its longitudinal axis by lateral laser irradiation. When the laser radiation is focused onto the wire surface, only parts of the wire length are coated. A uniform coating along the circumference is obtained either by rotation of the wire or by laser irradiation from several directions. By means of this coating method, thickened parts are formed on an endless wire at preliminarily chosen distances. The actual electrodes are then obtained by separation into corresponding subelements.

With respect to the electrodes proposed according to the prior art, the electrodes for gas discharge lamps obtained by means of CVD methods have the following advantages:

the material composition can be greatly varied with the use of the conventional CVD technique, as a result of which, for example, many doping possibilities are provided;

the carrier, for example, the metal pin or the lead-in wire, is not necessarily rotation-symmetrical with respect to its longitudinal axis;

the form of the thickened part can be varied without great difficulty in accordance with the choice of the CVD deposition conditions. In mechanical methods, this is possible only to a limited extent;

the dome material is compact and homogeneous so that with high thermal loads no disturbances due to gas bursts or the like are to be expected;

the electrodes can be manufactured simultaneously in large quantities with narrow tolerances;

the size of the electrodes is not limited by mechanical manufacturing techniques. A miniaturization can be readily attained;

in conventional electrodes, the lead-through part has to be made of a material compatible with that of the lamp envelope, whose temperature resistance can be distinctly lower than that of the electrode pin. In electrodes manufactured by CVD methods, the lead-through part and the electrode pin can consist of the same material. In this case, the compatibility between lamp envelope and lead-through part is obtained by an additional coating by CVD.

Electrodes manufactured by the laser-supported CVD method have the following further advantages:

due to the locally limited heating, only the area of the electrode dome is coated;

a rapid manufacture because of high outputs and a high rate of growth (more than 10 μm/min, as compared with 1 μm/min deposition rate in conventional CVD methods);

since the deposition in a CVD method is temperature-dependent, the profile of the deposited thickened part is formed by the temperature distrubution produced by means of the laser (that is to say that in general the deposited quantity is largest at the hottest areas).

The invention will now be described more fully with reference to the accompanying drawing, in which.

Figure 1:
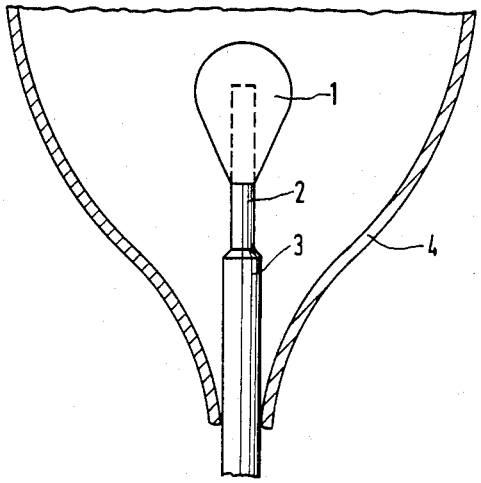
FIG. 1 is a diagrammatic sectional view of a side of a discharge lamp.

The lamp electrodes have the construction illustrated in FIG. 1. Because of the high temperatures, the thickened part of the electrode dome 1 usually consists of tungsten with or without dopings promoting the electron emission. The thickened part is formed on an electrode pin 2, which then passes into the lead-through part 3. The part 3 may be a pin, a foil or a combination of pin and foil. Whereas the pin 2 usually consists of tungsten or similar metals, the material of the lead-through part has to be chosen so that a gas-tight passage through the glass envelope 4 can be obtained.

Figure 2:
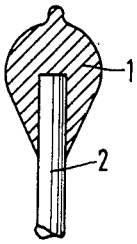
FIG. 2 shows an electrode structure in sectional view.

FIG. 2 is a sectional view of an example of an electrode structure with a rotation-symmetrical thickened part or electrode dome 1.

Figure 3:
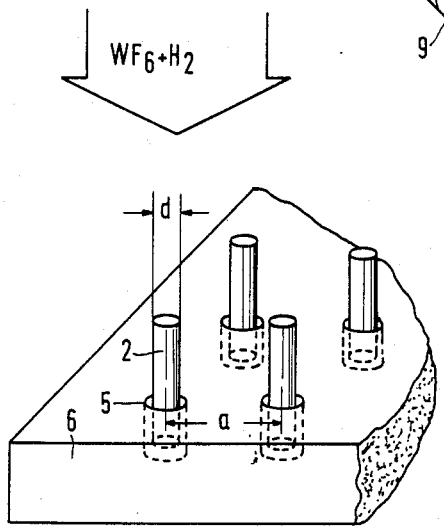
FIG. 3 shows diagrammatically the coating method.

FIG. 3 shows diagrammatically the coating method. Pins 2 of a heavy metal having diameters d of 0.05 to 1 mm are located at relative distances a of 0.5 to 10 mm in the perforations 5, having a diameter of 0.2 to 1.5 mm and arranged in the form of a matrix in a temperature-resistent substrate holder 6. This holder 6 is isothermally heated together with the pins in a CVD reactor (not shown) to temperatures between 600° C. and 1100° C. The gaseous starting materials indicated by an arrow, such as, for example, $WF_6$ and $H_2$, are introduced into the reactor at flow rates between 10 to 200 sccm and between 30 and 2000 sccm, respectively, where sccm designates cubic centimeters per minute under normal conditions. The pump power is regulated so that gas pressures of 1 to 5 mbar are adjusted.

Figure 4:
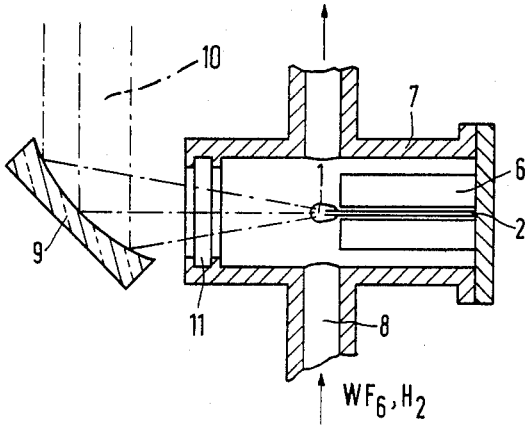
FIGS. 4 to 7 show diagrammatically embodiments of the laser-supported and laser-heated coating method, respectively.

FIG. 4 shows diagrammatically a device for a laser-supported electrode coating. A pin 2 arranged in a reactor 7 and having diameters of 0.05 to 1 mm projects over 1 to 5 mm from a holder 6 and is laterally surrounded by a flow of a gas mixture of $WF_6$ and $H_2$, which is introduced into the reactor through a gas inlet 8. From the end face of the reactor, the heating is effected by means of a laser beam 10, which is focused by a concave mirror 9 and is coupled through a window 11 transparent to the laser beam into the reactor space. Of course, a different method of focusing may also be used. The laser power is regulated so that the part of the radiation absorbed by the pin heats this pin to temperatures between 600° and 1500° C. The pin temperature is measured pyrometrically through additional windows (not shown).

Higher pressures are possible, but is has to be taken into account that the laser power density coupled into the gas does not yet lead to a strong deposition of tungsten from the gaseous phase. This can be avoided by a strongly convergent radiation path. With sufficiently short diffusion lengths, a "pregermination" in the gaseous phase is not necessarily disadvantageous, but may lead to a particularly finely crystalline deposition at a high rate.

Figure 5:
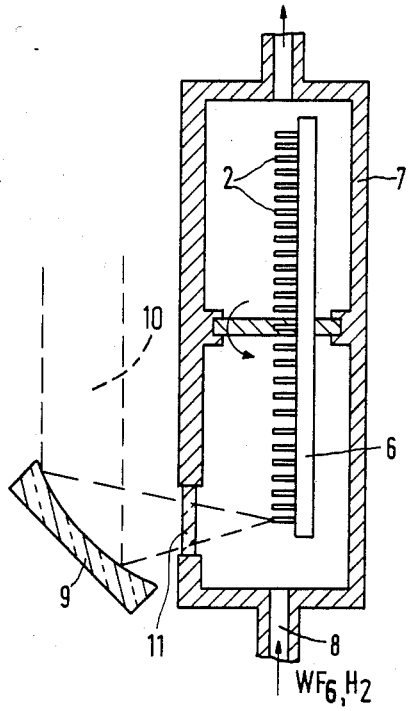

FIG. 5 shows a further example of the laser-heated electrode coating. In this case, several electrode pins 2 are arranged in a holder 6 similar to a turret drum. The holder can be rotated so that the electrodes are successively rotated into the laser beam 10 and are coated.

Figure 6:
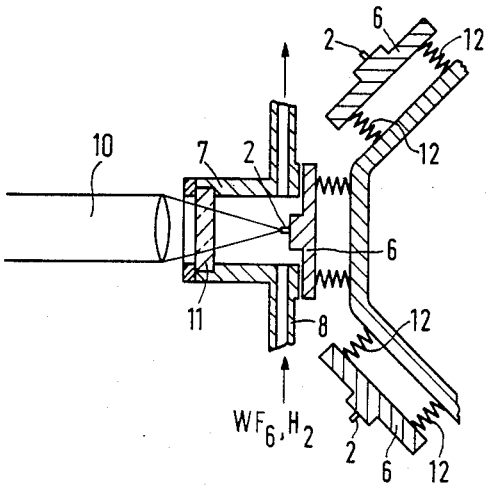

FIG. 6 illustrates an arrangement for continuous operation. In this case, holders 6 with inserted pins 2 are successively introduced into the reactor 7, the springs 12 being flanged thereto in a prevacuum-tight manner. After the pin has been coated, the holder is lifted off and the finished electrode is removed. The next holder can then be flanged thereto. In contrast with the conventional coating arrangements, no long cooling times have to be taken into account before the reactor is opened because the electrode is cooled very rapidly after the laser is switched off due to the low heat capacity.

Figure 7:
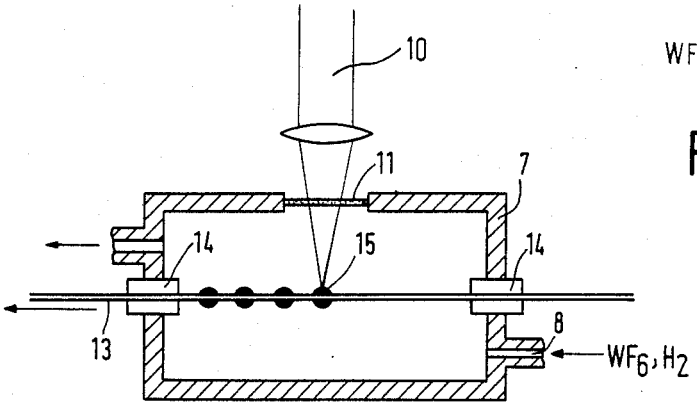

An embodiment for lateral laser irradiation is shown in FIG. 7. In this case, a carrier wire 13 is pulled stepwise through gas-tight lead-through sleeves 14 into a reactor 7 and heated therein laterally by a focused laser beam 10 through a window 11. Then a subzone of the wires is coated. After this partial coating has been realized, the wire is transported further in the direction indicated by an arrow over the desired electrode pin length and the next thickened part 15 is formed. The carrier wire provided with thickened parts is led out of the reactor, for example, through a lock (not shown). Thus, a quasi continuous electrode manufacture is possible. The electrode pins are obtained from the carrier wire 13 by separation of the wire on one side of each thickened part 15.

In order to manufacture electrodes, lengths of wire of different materials were coated by the described methods with tungsten in such a manner that the desired thickened parts at the electrode tips were formed. On the contrary, at the lower ends the lengths of wire remained uncoated and therefore were suitable for a gas-tight passage through the lamp envelope. Examples of such structures are:

tungsten on molybdenum wire,
(wire diameter 300 μm)
(dome diameter 760 μm)
Tungsten on niobium wire
(wire diameter 300 μm dome diameter 1200 μm)
Tungsten on tungsten wire
(wire diameter 50 μm dome diameter 450 μm).

What is claimed is:

1. A method of manufacturing an electrode for a high-pressure gas discharge lamp, in which a thickened part of a high-melting metal is formed on a carrier of a high-melting metal characterized in that the carrier is coated by reactive deposition from the gaseous phase with a layer protecting against corrosion and then the thickened part is formed by reactive deposition from the gaseous phase.

2. The method of claim 1 wherein the carrier consists of a metal selected from the group consisting of niobium, molybdenum and tungsten and the thickened part consists of tungsten.

3. The method of claim 1 wherein the thickened part contains an emitter material.

4. The method of claim 1 wherein the layer protecting against corrosion is tantalum layer.

5. The method of claim 1 wherein the thickened part is doped by simultaneous deposition with an emitter material.

6. The method of claim 5 wherein the emitter material is thorium.

7. The method of claim 1 wherein the thickened part is formed by laser-supported deposition from the gaseous phase.

8. The method of claim 7 wherein the carrier is heated by a $CO_2$ laser.

9. The method of claim 7 wherein the carrier is heated by a Nd-YAG laser.

10. The method of claim 7 wherein the thickened part is obtained by lateral laser irradiation of discrete areas of an endless wire as a carrier.

11. The method of claim 7 characterized in that as carriers several pins are arranged in a turret drum and are heated successively by the laser.

12. The method of claim 7 characterized in that as carriers several pins and holders are successively passed into a reactor, flanged thereto, and removed from the reactor.

* * * * *

UNITED STATES PATENT AND TRADEMARK OFFICE

CERTIFICATE OF CORRECTION

PATENT NO. : 4,525,379

DATED : June 25, 1985

INVENTOR(S) : HORST HUBNER ET AL

It is certified that error appears in the above-identified patent and that said Letters Patent is hereby corrected as shown below:

Column 6, line 68 after "is" insert --a--.

Signed and Sealed this

*Fifteenth* Day of *October 1985*

[SEAL]

*Attest:*

DONALD J. QUIGG

*Attesting Officer*

*Commissioner of Patents and Trademarks—Designate*